US006749762B2

(12) United States Patent
Lee et al.

(10) Patent No.: US 6,749,762 B2
(45) **Date of Patent: *Jun. 15, 2004**

(54) BUBBLE-JET TYPE INK-JET PRINTHEAD AND MANUFACTURING METHOD THEREOF

(75) Inventors: Chang-seung Lee, Seoul (KR); Kyoung-won Na, Yongin (KR); Sang-wook Lee, Seongnam (KR); Hyun-cheol Kim, Seoul (KR); Yong-soo Oh, Seongnam (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/255,757

(22) Filed: Sep. 27, 2002

(65) Prior Publication Data

US 2003/0030700 A1 Feb. 13, 2003

Related U.S. Application Data

(62) Division of application No. 09/907,456, filed on Jul. 18, 2001, now Pat. No. 6,533,399.

(30) Foreign Application Priority Data

Jul. 18, 2000 (KR) ..... 2000-41154

(51) Int. Cl.[7] ..... B41J 2/16

(52) U.S. Cl. ..... 216/27; 216/46; 216/67; 216/79; 216/99; 438/21

(58) Field of Search ..... 216/27, 46, 67, 216/79, 99; 438/21

(56) References Cited

U.S. PATENT DOCUMENTS 3,890,623 A 6/1975 Schmid 4,219,822 A 8/1980 Paranjpe (List continued on next page.)

FOREIGN PATENT DOCUMENTS

| | | |
|---|---|---|
| DE | 30 28 404 | 7/1982 |
| EP | 0 244 214 | 11/1987 |
| EP | 0 317 171 | 5/1989 |
| EP | 0 321 075 | 6/1989 |
| EP | 0 352 498 | 1/1990 |
| EP | 0 352 726 | 1/1990 |
| EP | 0 359 417 | 3/1990 |
| EP | 0 763 430 | 3/1997 |
| JP | 56-144160 | 11/1981 |

(List continued on next page.)

OTHER PUBLICATIONS

Tseng, et al, "A Novel Microinjector with Virtual Chamber Neck", IEEE Workshop on Micro Electro Mechanical Systems, New Yor NY/US, IEEE, pp. 57–62, (Jan. 25, 1998).

*Primary Examiner*—Anita Alanko
(74) *Attorney, Agent, or Firm*—Lee & Sterba, P.C.

(57) ABSTRACT

A bubble-jet type ink-jet printhead, and a manufacturing method thereof are provided, wherein, the printhead includes a substrate integrally having an ink supply manifold, an ink chamber, and an ink channel, a nozzle plate having a nozzle, a heater consisting of resistive heating elements, and an electrode for applying current to the heater. In particular, the ink chamber is formed in a substantially hemispherical shape on a surface of the substrate, a manifold is formed from its bottom side toward the ink chamber, and the ink channel linking the manifold and the ink chamber is formed at the bottom of the ink chamber. Thus, this simplifies the manufacturing process and facilitates high integration and high volume production. Furthermore, a doughnut-shaped bubble is formed to eject ink in the printhead, thereby preventing a back flow of ink as well as formation of satellite droplets that may degrade image resolution.

10 Claims, 15 Drawing Sheets

U.S. PATENT DOCUMENTS

| | | | | | |
|---|---|---|---|---|---|
| 4,275,290 | A | | 6/1981 | Cielo et al. | |
| 4,330,787 | A | | 5/1982 | Sato et al. | |
| 4,339,762 | A | | 7/1982 | Shirato et al. | |
| 4,353,079 | A | | 10/1982 | Kawanabe | |
| 4,376,945 | A | | 3/1983 | Hara et al. | |
| 4,429,321 | A | | 1/1984 | Matsumoto | |
| 4,463,359 | A | | 7/1984 | Ayata et al. | |
| 4,490,728 | A | | 12/1984 | Vaught et al. | |
| 4,521,805 | A | | 6/1985 | Ayata et al. | |
| 4,536,097 | A | | 8/1985 | Nilsson | |
| 4,580,149 | A | | 4/1986 | Domoto et al. | |
| 4,611,219 | A | | 9/1986 | Sugitani et al. | |
| 4,675,693 | A | | 6/1987 | Yano et al. | |
| 4,675,694 | A | | 6/1987 | Bupara | |
| 4,675,696 | A | | 6/1987 | Suzuki | |
| 4,723,129 | A | | 2/1988 | Endo et al. | |
| 4,812,859 | A | | 3/1989 | Chan et al. | |
| 4,831,390 | A | | 5/1989 | Deshpande et al. | |
| 4,847,630 | A | | 7/1989 | Bhaskar et al. | |
| 4,864,328 | A | | 9/1989 | Fischbeck | |
| 4,864,329 | A | | 9/1989 | Kneezel et al. | |
| 4,882,595 | A | | 11/1989 | Trueba et al. | |
| 4,889,587 | A | | 12/1989 | Komuro | |
| 4,894,664 | A | | 1/1990 | Pan | |
| 4,914,562 | A | | 4/1990 | Abe et al. | |
| 4,985,710 | A | | 1/1991 | Drake et al. | |
| 5,038,153 | A | | 8/1991 | Liechti et al. | |
| 5,211,754 | A | | 5/1993 | Komuro | |
| 5,305,018 | A | | 4/1994 | Schantz et al. | |
| 5,636,441 | A | | 6/1997 | Meyer et al. | |
| 5,760,804 | A | | 6/1998 | Heinzl et al. | |
| 5,825,385 | A | | 10/1998 | Silverbrook | |
| 5,841,452 | A | * | 11/1998 | Silverbrook | 347/47 |
| 5,850,241 | A | * | 12/1998 | Silverbrook | 347/54 |
| 6,019,457 | A | | 2/2000 | Silverbrook | |
| 6,042,222 | A | | 3/2000 | Moritz, III et al. | |
| 6,143,190 | A | * | 11/2000 | Yagi et al. | 216/27 |

FOREIGN PATENT DOCUMENTS

| | | | | | |
|---|---|---|---|---|---|
| JP | 57-74180 | | | 5/1982 | |
| JP | 1-190458 | | | 7/1989 | |
| JP | 1-304951 | | | 12/1989 | |
| JP | 2-227254 | | | 9/1990 | |
| JP | 04241955 | A | * | 8/1992 | B41J/2/16 |
| JP | 5-29638 | | | 5/1993 | |
| JP | 5-338178 | | | 12/1993 | |
| JP | 6-191042 | | | 7/1994 | |
| JP | 7-156402 | | | 6/1995 | |
| JP | 9-169117 | | | 6/1997 | |
| JP | 11-105279 | | | 4/1999 | |

* cited by examiner

BUBBLE-JET TYPE INK-JET PRINTHEAD AND MANUFACTURING METHOD THEREOF

This application is a DIVISION of application Ser. No. 09/907,456, filed Jul. 18, 2001 now U.S. Pat. No. 6,533,399.

BACKGROUND OF THE INVENTION

1. Field of the Invention

The present invention relates to an ink-jet printhead. More particularly, the present invention relates to a bubble-jet type ink-jet printhead, a manufacturing method thereof, and a method of ejecting ink.

2. Description of the Related Art

Ink ejection mechanisms of an ink-jet printer are largely categorized into two types: an electro-thermal transducer type (bubble-jet type) in which a heat source is employed to form a bubble in ink causing ink droplets to be ejected, and an electro-mechanical transducer type in which a piezoelectric crystal bends to change the volume of ink causing ink droplets to be expelled.

With reference to FIGS. 1A and 1B, a conventional bubble-jet type ink ejection mechanism will now be described. When a current pulse is applied to a heater 12 consisting of resistive heating elements formed in an ink channel 10 where a nozzle 11 is located, heat generated by the heater 12 boils ink 14 to form a bubble 15 within the ink channel 10, which causes an ink droplet 14' to be ejected.

To be useful, an ink-jet printhead having this bubble-jet type ink ejector must meet the following conditions. First, it must have a simplified manufacturing process, i.e., a low manufacturing cost and a high volume of production must be possible. Second, to produce high quality color images, creation of minute satellite droplets that trail ejected main droplets must be prevented. Third, when ink is ejected from one nozzle, or ink refills an ink chamber after ink ejection, cross-talk with an adjacent nozzle, from which no ink is ejected, must be prevented. To this end, a back flow of ink in the opposite direction of a nozzle must be avoided during ink ejection. Another heater 13 illustrated in FIGS. 1A and 1B is provided for this purpose. This second heater 13 is similarly capable of forming a bubble 16. Fourth, for high speed printing, a cycle beginning with ink ejection and ending with ink refill must be as short as possible. That is, an operating frequency must be high.

However, the above conditions tend to conflict with one another, and furthermore, the performance of an ink-jet printhead is closely associated with structures of an ink chamber, an ink channel, and a heater, the type of formation and expansion of bubbles, and the relative size of each component.

In efforts to overcome problems related to the above requirements, ink-jet printheads having a variety of structures have been proposed in, for example, U.S. Pat. Nos. 4,339,762; 4,882,595; 5,760,804; 4,847,630; and 5,850,241; European Patent No. 317,171, and an article by Fan-Gang Tseng, Chang-Jin Kim, and Chih-Ming Ho entitled, "A Novel Microinjector with Virtual Chamber Neck", IEEE MEMS '98, pp. 57–62]. However, the ink-jet printheads proposed in the above patents or literature may satisfy some of the aforementioned requirements but do not completely provide an improved ink-jet printing approach.

SUMMARY OF THE INVENTION

It is a feature of an embodiment of the present invention to provide a bubble-jet type ink-jet printhead having a structure that satisfies the above-mentioned requirements.

It is another feature of an embodiment of the present invention to provide a method of manufacturing the bubble-jet type ink-jet printhead having a structure that satisfies the above-mentioned requirements.

It is a further feature of an embodiment of the present invention to provide a method of ejecting ink in a bubble-jet type ink printhead.

In order to provide the first feature, an embodiment of the present invention provides an ink-jet printhead including a substrate having an ink supply manifold, an ink chamber, and an ink channel, a nozzle plate having a nozzle, and a heater consisting of resistive heating elements, and an electrode for applying current to the heater. The ink chamber, in which ink to be ejected is filled, is formed in a substantially hemispherical shape on a surface of the substrate, a manifold is formed from its bottom side toward the ink chamber, and the ink channel linking the manifold and the ink chamber is formed at the bottom of the ink chamber. The ink chamber, the manifold, and the ink channel are integrally formed on the substrate. Thus, the substrate has a structure in which the ink chamber, the ink channel, and the manifold are arranged vertically from its surface.

The nozzle plate is stacked on the substrate, and the nozzle plate has a nozzle at a location corresponding to a central portion of the ink chamber. The heater is formed in an annular shape on the nozzle plate and centered around the nozzle of the nozzle plate. Preferably, the diameter of the ink channel is equal to or less than that of the nozzle.

In a preferred embodiment, a bubble guide and a droplet guide, both of which extend down the edges of the nozzle in the depth direction of the ink chamber are formed to guide the direction in which a bubble grows and the shape of the bubble, and the ejection direction of an ink droplet during ink ejection, respectively. The heater is formed in the shape of the character "O" or "C" so that the bubble has a substantially doughnut shape.

In order to provide the second feature, an embodiment of the present invention provides a method of manufacturing a bubble-jet type ink-jet printhead, in which a substrate is etched to integrally form an ink chamber, an ink channel, and ink supply manifold thereon. More specifically, a nozzle plate is formed on a surface of the substrate, and an annular heater is formed on the nozzle plate. The ink supply manifold is formed from a bottom side of the substrate toward the surface. An electrode for applying current to the annular heater is formed. A nozzle plate is etched to form a nozzle having a diameter less than an inner diameter of the annular heater. The substrate exposed by the nozzle is etched to form the ink chamber having a substantially hemispherical shape and a diameter greater than the annular heater. The bottom of the ink chamber is etched to form the ink channel linking the ink chamber and the manifold.

In a preferred embodiment, the ink chamber is formed by anisotropically etching the substrate exposed by the nozzle to a predetermined depth, or by first anisotropically etching the substrate exposed by the nozzle and then isotropically etching it so that the ink chamber has a hemispherical shape.

In a preferred embodiment, the ink chamber is formed by anodizing a portion of the substrate, in which the ink chamber is to be formed, to form a porous layer in a substantially hemispherical shape and then selectively etching and removing the porous layer.

In a preferred embodiment, the ink channel is formed by forming an etch mask, which exposes the substrate with a diameter less than the nozzle formed on the nozzle plate, forming the ink chamber and the ink channel using the etch mask, and removing the etch mask.

In a preferred embodiment, the ink chamber is formed by anisotropically etching the substrate exposed by the nozzle to a predetermined depth and forming a hole, depositing a predetermined material layer over the anisotropically etched substrate to a predetermined thickness, anisotropically etching the material layer to expose the bottom of the hole while forming a spacer of the material layer along a sidewall of the hole, and isotropically etching the substrate exposed to the bottom of the hole.

According to an embodiment of the present invention, a bubble is formed in a substantially doughnut shape conforming to the shape of the heater, thereby satisfying the above requirements for ink ejection. Furthermore, this embodiment permits a simple manufacturing process and high volume production of printheads in chips.

These and other features and advantages of the embodiments of the present invention will be readily apparent to those of ordinary skill in the art upon review of the detailed description that follows.

BRIEF DESCRIPTION OF THE DRAWINGS

The above features and advantages of the present invention will become more apparent by describing in detail preferred embodiments thereof with reference to the attached drawings in which.

DETAILED DESCRIPTION OF THE PREFERRED EMBODIMENTS

Figure 1A:
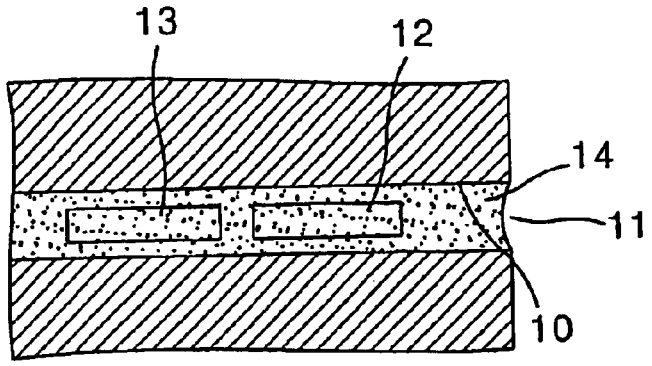
FIG. 1A (PRIOR ART)
FIGS. 1A and 1B illustrate cross-sections showing the structure of a conventional bubble-jet ink jet printhead along with an ink ejection mechanism.
Figure 1B:
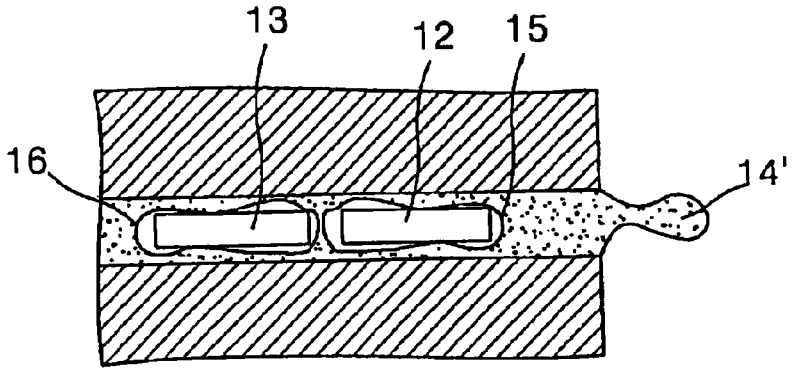
FIG. 1B (PRIOR ART)

Korean Patent Application No. 00-41154, filed on Jul. 18, 2000, and entitled: "Bubble-jet Type Ink-Jet Printhead and Manufacturing Method Thereof," is incorporated by reference herein in its entirety.

The present invention will now be described more fully with reference to the accompanying drawings, in which preferred embodiments of the invention are shown. This invention may, however, be embodied in many different forms and should not be construed as being limited to the embodiments set forth herein. Rather, these embodiments are provided so that this disclosure will be thorough and complete, and will fully convey the concept of the invention to those skilled in the art. In the drawings, the shapes and thicknesses of elements may be exaggerated for clarity, and the same reference numerals appearing in different drawings represent the same element. Further, it will be understood that when a layer is referred to as being "on" another layer or substrate, it can be directly on the other layer or substrate, or intervening layers may also be present.

Figure 2:
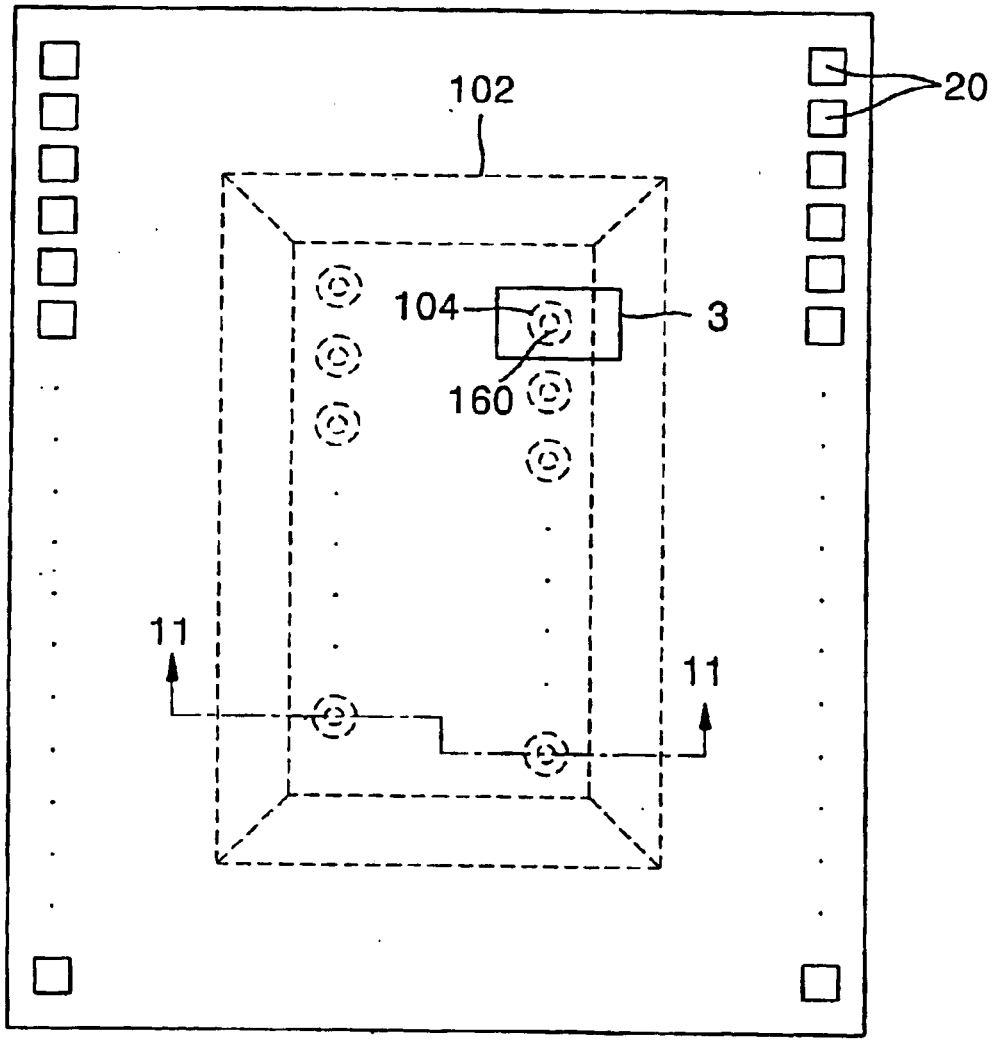
FIG. 2 illustrates a schematic plan view of a bubble-jet type ink-jet printhead according to an embodiment of the present invention.

Referring to FIG. 2, in a printhead according to the present invention, ink ejectors 3 are arranged in two rows in a staggered fashion along both sides of an ink supply manifold 102 shown with a dotted line. Bonding pads 20, to which wires are bonded, electrically connect to each ink ejector 3. Furthermore, the manifold 102 is connected to an ink container (now shown) for holding ink. Although the ink ejectors 3 are arranged in two rows as illustrated in FIG. 2, they may also be arranged in a single row. Alternatively, to achieve high resolution, they may be arranged in three rows. Furthermore, although the printhead using a single color of ink is illustrated in FIG. 2, three or four groups of ink ejectors may be disposed, one group for each color, for color printing.

Figure 3:
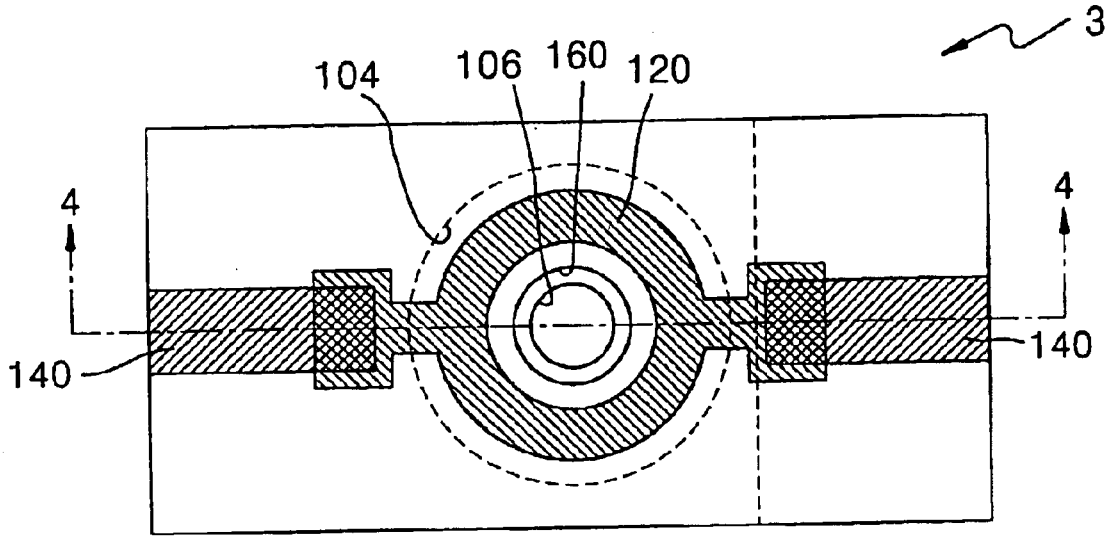
FIG. 3 illustrates an enlarged plan view of the unit ink ejector of FIG. 2.
Figure 4:
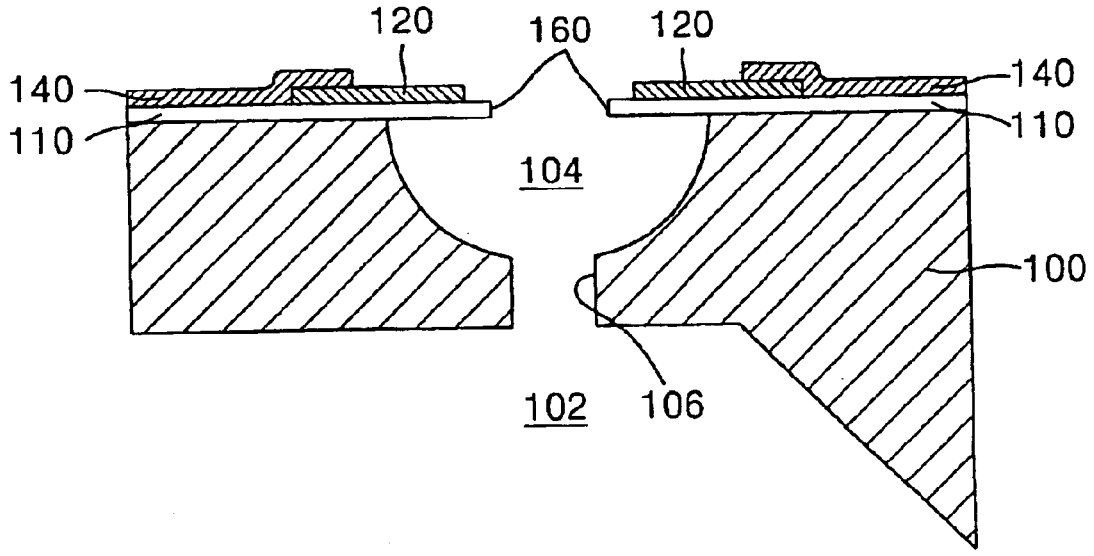
FIG. 4 illustrates a cross-section of the ink ejector taken along line 4—4 of FIG. 3.

FIG. 3 illustrates an enlarged plan view of the ink ejector 3 featured in the present invention, and FIG. 4 illustrates a cross-section showing a vertical structure of the ink ejector 3 taken along line 4—4 of FIG. 3. The structure of a printhead according to an embodiment of the present invention will now be described in detail with reference to FIGS. 3 and 4.

An ink chamber 104, in which ink is filled, is formed on the surface of a substrate 100 in a substantially hemispherical shape. The manifold 104, for supplying ink to each ink chamber 104, is formed on a bottom side of the substrate 100. An ink channel 106, linking the ink chamber 104 and the manifold 102, is formed at a central bottom surface of the ink chamber 104. Here, the substrate 100 is preferably formed from silicon widely used in manufacturing integrated circuits. Although the diameter of the ink channel 106 is shown to be less than that of a nozzle 160 in FIGS. 3 and 4, it does not need to be so. However, since the diameter of the ink channel 106 affects a back flow of ink being pushed back into the ink channel 106 during ink ejection and the speed at which ink refills after ink ejection, preferably, it is finely controlled when forming the ink channel 106. The formation of the ink channel 106 will be described below.

A nozzle plate 110 having the nozzle 160 is formed on the substrate 100 thereby forming an upper wall of the ink chamber 104. If the substrate 100 is formed of silicon, the nozzle plate 110 may be formed from a silicon oxide layer formed by oxidation of the silicon substrate 100 or from an insulating layer such as a silicon nitride layer deposited on the substrate 100.

A heater 120 for bubble formation, which substantially has the shape of the character "O" in which "C"-shaped parts are symmetrically coupled, is formed on the nozzle plate 110 in an annular shape centered around the nozzle 160. The heater 120 consists of resistive heating elements, such as polycrystalline silicon doped with impurities or tantalum-aluminum. Electrodes 140 are connected to the heater 120 for applying pulse current. The electrodes 140 are typically formed from the same material as the bonding pad (20 of FIG. 2) and necessary wiring lines (not shown) such as aluminum or aluminum alloy.

Figure 5:
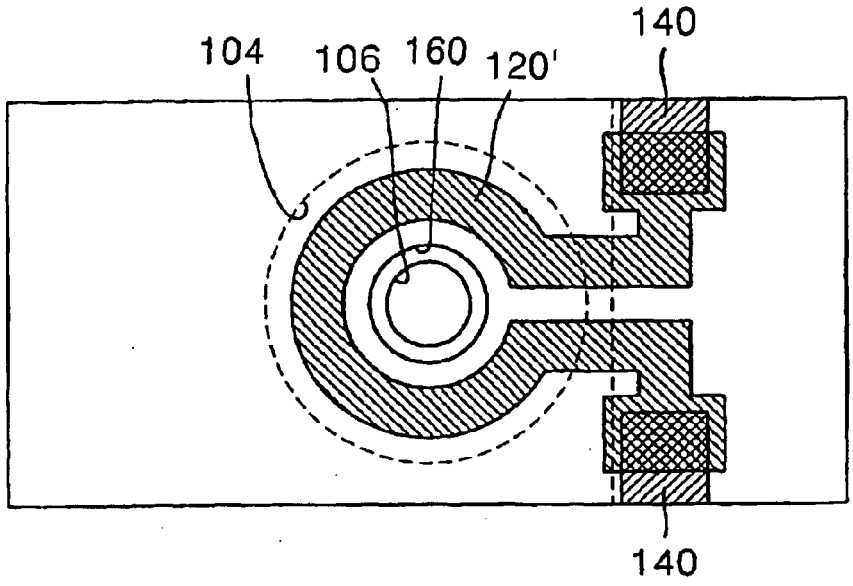
FIG. 5 illustrates a plan view showing another example of the unit ink ejector of FIG. 2.

FIG. 5 illustrates a plan view showing a modified example of a heater. A heater 120' is formed substantially in the shape of the character "C", and one of the electrodes 140 is connected to each end of the C-shaped heater. That is, the two symmetrical C-shaped parts of the heater 120 illustrated in FIG. 3 are coupled in parallel between the electrodes 140, whereas those of the heater 120' illustrated in FIG. 5 are coupled in series therebetween.

Figure 6:
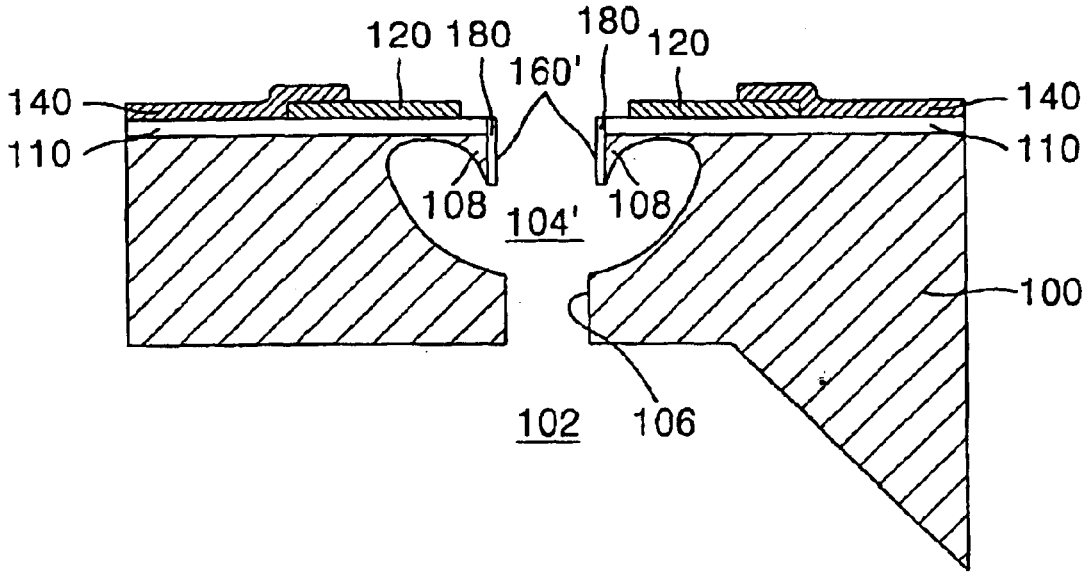
FIG. 6 illustrates a cross-section of another example of an ink ejector taken along line 4—4 of FIG. 3.

FIG. 6 illustrates a cross-section showing a modified example of an ink chamber. A droplet guide 180 and a bubble guide 108 are formed in an ink chamber 104'. The droplet guide 180 extends down the edge of a nozzle 160' toward the ink chamber 104', and the bubble guide 108 is formed under the nozzle plate 110, which forms the upper wall of the ink chamber 104', with substrate material remaining along the inner surface of the droplet guide 180. The functions of the droplet guide 180 and the bubble guide 108 will be described below.

Figure 7A:
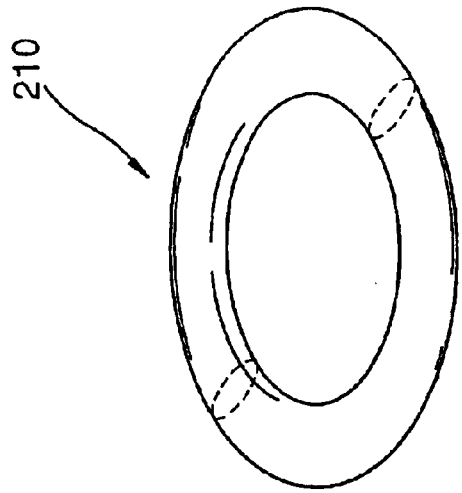
FIGS. 7 and 8 illustrate cross-sections showing an ink ejection mechanism of the ink ejector of FIG. 4.
Figure 7:
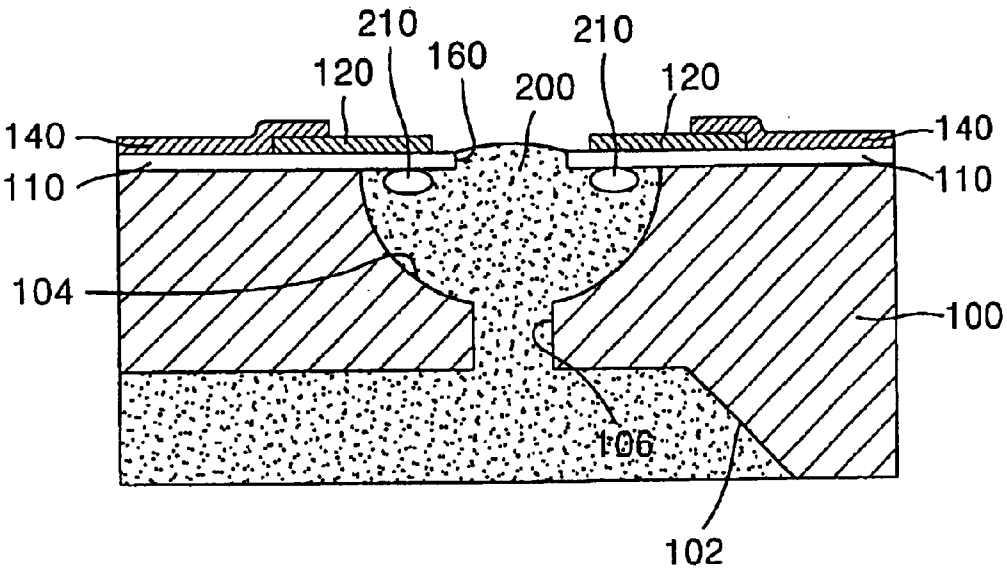

The function and effect of an ink-jet printhead according to an embodiment of the present invention configured as described above will now be described together with the ink ejection mechanism. FIGS. 7 and 8 illustrate cross-sections showing the ink ejection mechanism of the ink ejector of FIG. 4.

As illustrated in FIG. 7, if a current pulse is applied to the annular heater 120 when the ink chamber 104 is filled with ink 200 supplied through the manifold 102 and the ink channel 106 by capillary action, then heat generated by the heater 120 is transmitted through the underlying nozzle plate 110, which boils the ink 200 under the heater 120 to form a bubble 210. The bubble 210 has a doughnut shape conforming to the annular heater 120 as illustrated in FIG. 7A.

Figure 8A:
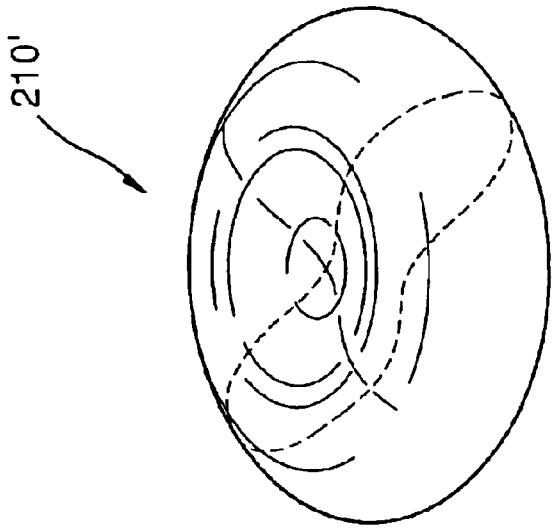
Figure 8:
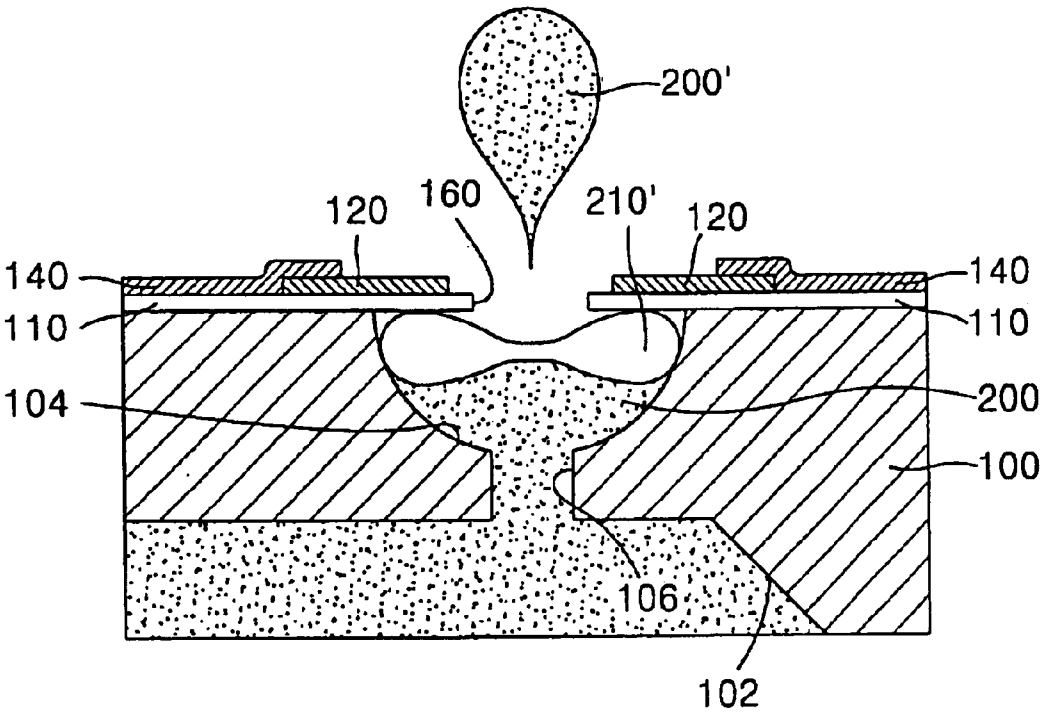

If the doughnut-shaped bubble 210 expands, the bubble 210 coalesces below the nozzle 160 to form a substantially disk-shaped bubble 210', the center portion of which is concave, as illustrated in FIG. 8A. At the same time, the expanding bubble 210' causes the ink 200' in the ink chamber 104 to be ejected.

If the applied current is cut off, the heater 120 cools causing a bubble to shrink or collapse, and then ink 200 refills the ink chamber 104.

According to an ink ejection mechanism of the printhead according to the current embodiment, the doughnut-shaped bubble 210 coalesces at the center to cut off the tail of the ejected ink 200', thus preventing the formation of satellite droplets.

Furthermore, the expansion of the bubbles 210 and 210' is limited to within the ink chamber 104, which suppresses a back flow of the ink 200, so that cross-talk with an adjacent ink ejector does not occur. Furthermore, if the diameter of the ink channel 106 is less than that of the nozzle 160 as illustrated in FIG. 4, this arrangement is very effective in preventing a back flow of the ink 200.

Meanwhile, the area of the annular heater 120 is wide enough so as to be rapidly heated and cooled, which quickens a cycle beginning with the formation of the bubbles 210 or 210' and ending with the collapse, thereby allowing for a quick response rate and high driving frequency. Furthermore, since the ink chamber 104 has a hemispherical shape, a path along which the bubbles 210 and 210' expand is more stable compared to a conventional ink chamber having the shape of a rectangular solid or a pyramid, and bubbles form and expand quickly thus ejecting ink within a relatively short time.

Figure 9:
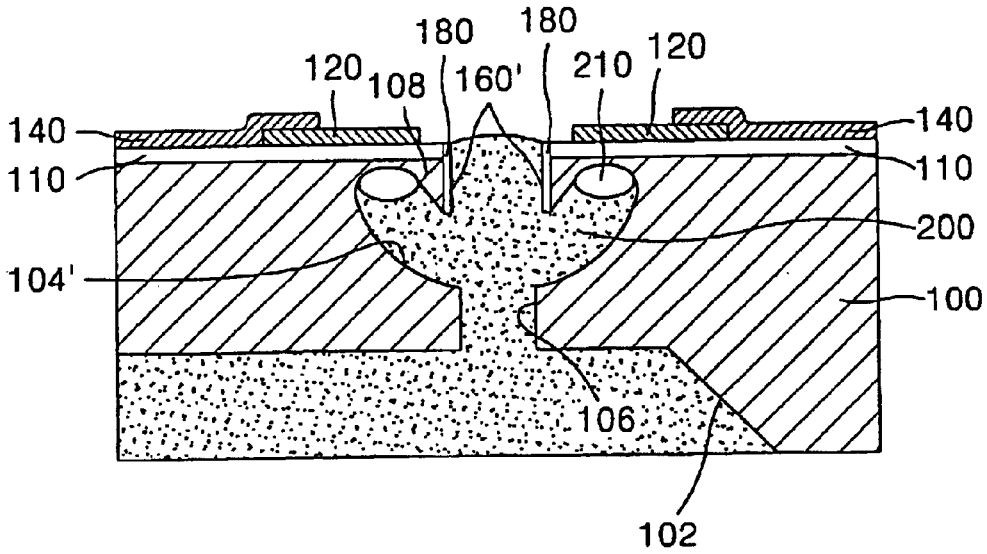
FIGS. 9 and 10 illustrate cross-sections showing an ink ejection mechanism of the ink ejector of FIG. 6.
Figure 10:
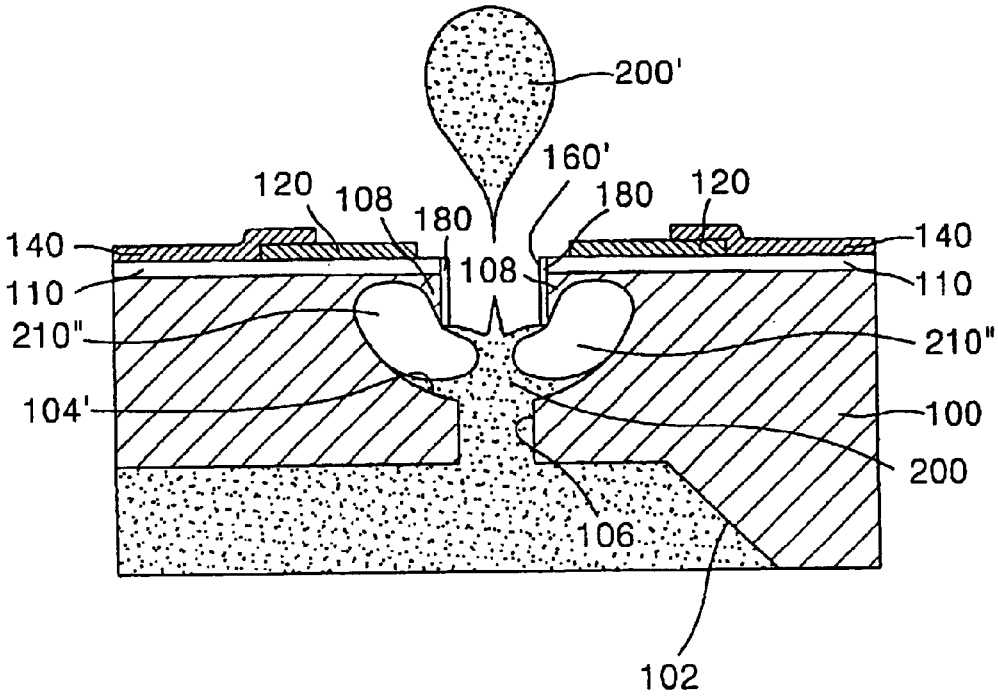

FIGS. 9 and 10 illustrate cross-sections showing an ink ejection mechanism for the ink ejector of FIG. 6. A difference from the ink ejection mechanism illustrated in FIGS. 7 and 8 will now be described.

First, since bubbles 210" expand downward due to the bubble guide 108 near the nozzle 160', there is little possibility that the bubbles 210" will coalesce below the nozzle 160'. However, the possibility that the expanding bubbles 210" will merge under the nozzle 160' may be controlled by controlling the length by which the droplet guide 180 and the bubble guide 108 extend downward. The ejection direction of the ejected droplet 200' is guided by the droplet guide 180 extending down the edges of the nozzle 160' so that the direction is perpendicular to the substrate 100.

A method of manufacturing an ink-jet printhead according to an embodiment of the present invention will now be described. FIGS. 11–16 illustrate cross-sections taken along line 11—11 of FIG. 2, which illustrate a method of manufacturing the printhead having the ink ejector of FIG. 4 according to an embodiment of the present invention.

First, the substrate 100 is prepared. A silicon substrate having a crystal orientation of [100] and having a thickness of about 500 $\mu$m is used as the substrate 100 in this embodiment. This is because the use of a silicon wafer widely used in the manufacture of semiconductor devices allows for high volume production. Next, if the silicon wafer is wet or dry oxidized in an oxidation furnace, front and rear (bottom) surfaces of the silicon substrate 100 are oxidized, thereby allowing silicon oxide layers 110 and 112 to grow. The silicon oxide layer 110 formed on the front surface of the substrate 100 will later be a nozzle plate where a nozzle is formed.

Figure 11:
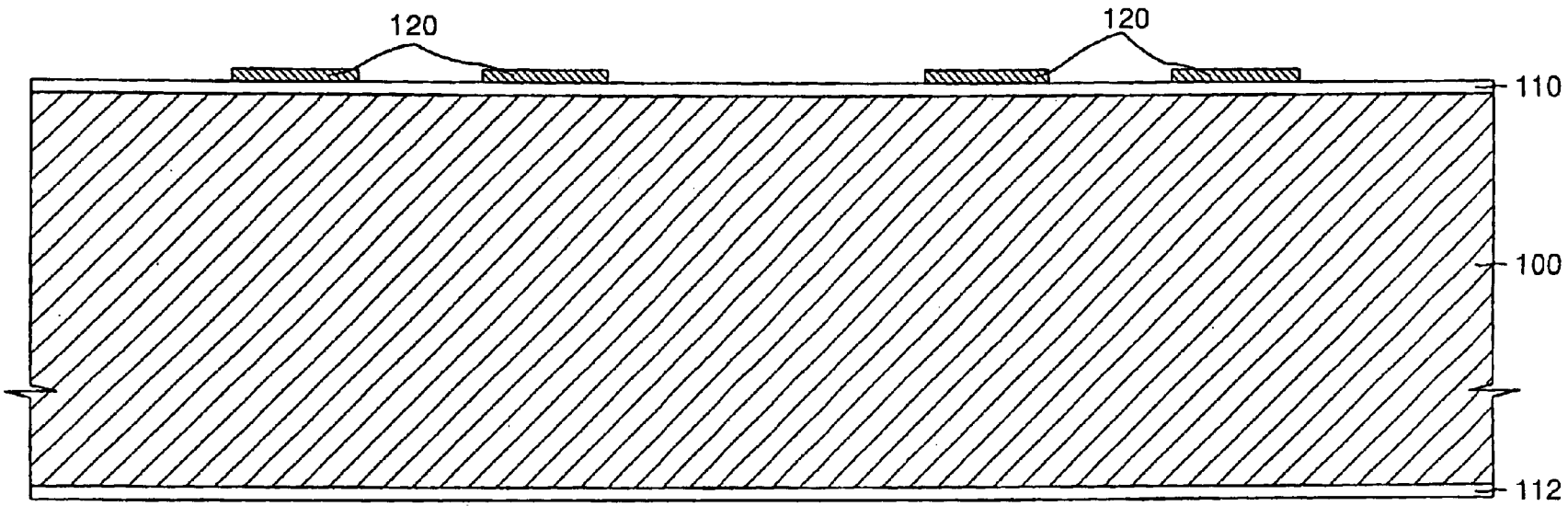
FIGS. 11–16 illustrate cross-sections taken along line 11—11 of FIG. 2, showing a method of a bubble-jet type ink-jet printhead according to an embodiment of the present invention having the ink ejector of FIG. 4.

A very small portion of the silicon wafer is illustrated in FIG. 11, and a printhead according to an embodiment of the present invention is fabricated by tens to hundreds of chips on a single wafer. Furthermore, as illustrated in FIG. 11, the silicon oxide layers 110 and 112 are developed on both front and rear surfaces of the substrate 100. This is because a batch type oxidation furnace exposed to an oxidation atmosphere is used on the rear surface of the silicon wafer as well. However, if a single wafer type oxidation apparatus exposing only a front surface of a wafer is used, the silicon oxide layer 112 is not formed on the rear surface of the substrate 100. For convenience, it will now be shown that a different material layer such a polycrystalline silicon layer, a silicon nitride layer and a tetraethyleorthosilicate (TEOS) oxide layer as will be described below, is formed only on the front surface of the substrate 100.

Next, the annular heater 120 is formed on the silicon oxide layer 110 formed on the front surface of the substrate 100 by depositing polycrystalline silicon doped with impurities or tantalum-aluminum over the silicon oxide layer 110 and patterning this in the form of an annulus. Specifically, the polycrystalline silicon layer doped with impurities may be formed by low pressure chemical vapor deposition (CVD) using a source gas containing phosphorous (P) as impurities, in which the polycrystalline silicon is deposited to a thickness of about 0.7–1 $\mu$m. If the heater 120 is formed from tantalum-aluminum, a tantalum-aluminum layer may be formed to a thickness of 0.1–0.3 $\mu$m by sputtering which uses tantalum-aluminum or tantalum and aluminum as a target. The thickness to which the polycrystalline silicon layer or the tantalum-aluminum layer may be deposited can be in different ranges so that the heater 120 may have appropriate resistance considering its width and length. The polycrystalline silicon layer or the tantalum-aluminum layer deposited over the silicon oxide layer 110 are patterned by photolithography using a photo mask and photoresist and an etching process using a photoresist pattern as an etch mask.

Figure 12:
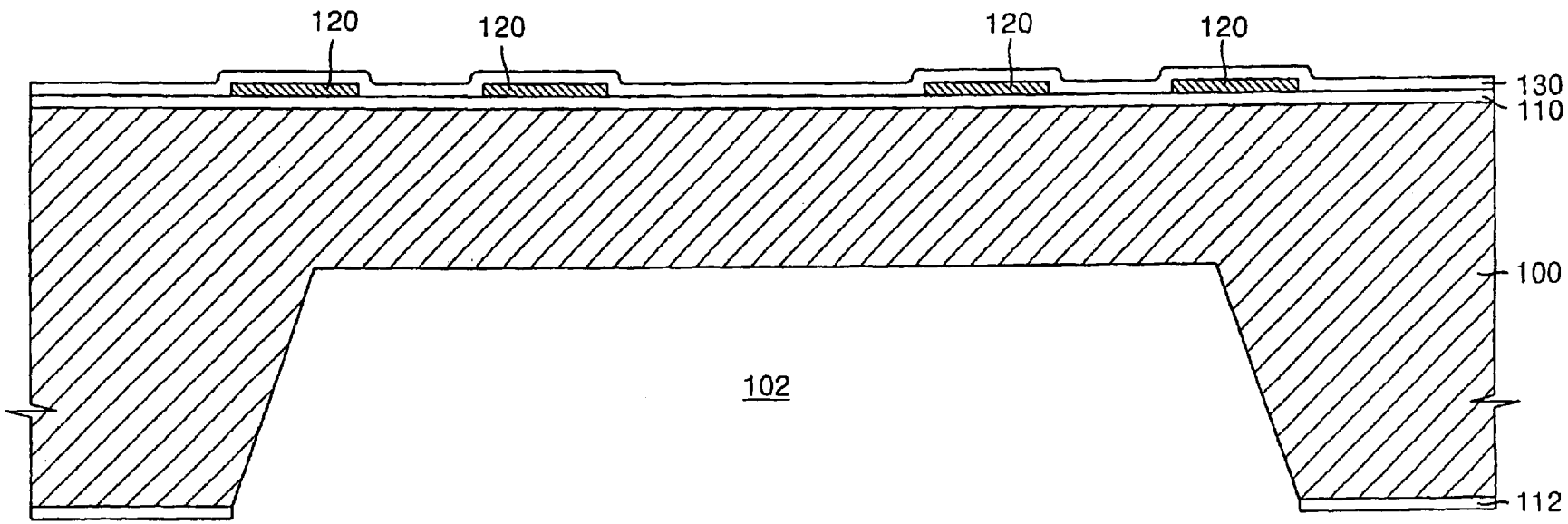

FIG. 12 illustrates a state in which a silicon nitride layer 130 has been deposited over the resulting structure of FIG.

11 and then the manifold 102 has been formed by etching the substrate 100 from its rear surface. The silicon nitride layer 130 may be deposited to a thickness of about 0.5 μm as a protective layer over the annular heater 120 also using low pressure CVD. The manifold 102 is formed by obliquely etching the rear surface of the wafer. More specifically, an etch mask that limits a region to be etched is formed on the rear surface of the wafer, and wet etching is performed for a predetermined period of time using tetramethyl ammonium hydroxide (TMAH) as an etchant. Accordingly, etching in a crystal orientation of [111] is slower than etching in other orientations to form the manifold 102 with a side surface inclined at 54.7°.

Although it has been described that the manifold 102 is formed by obliquely etching the rear surface of the substrate 100, the manifold 102 may be formed by anisotropic etching.

Figure 13:
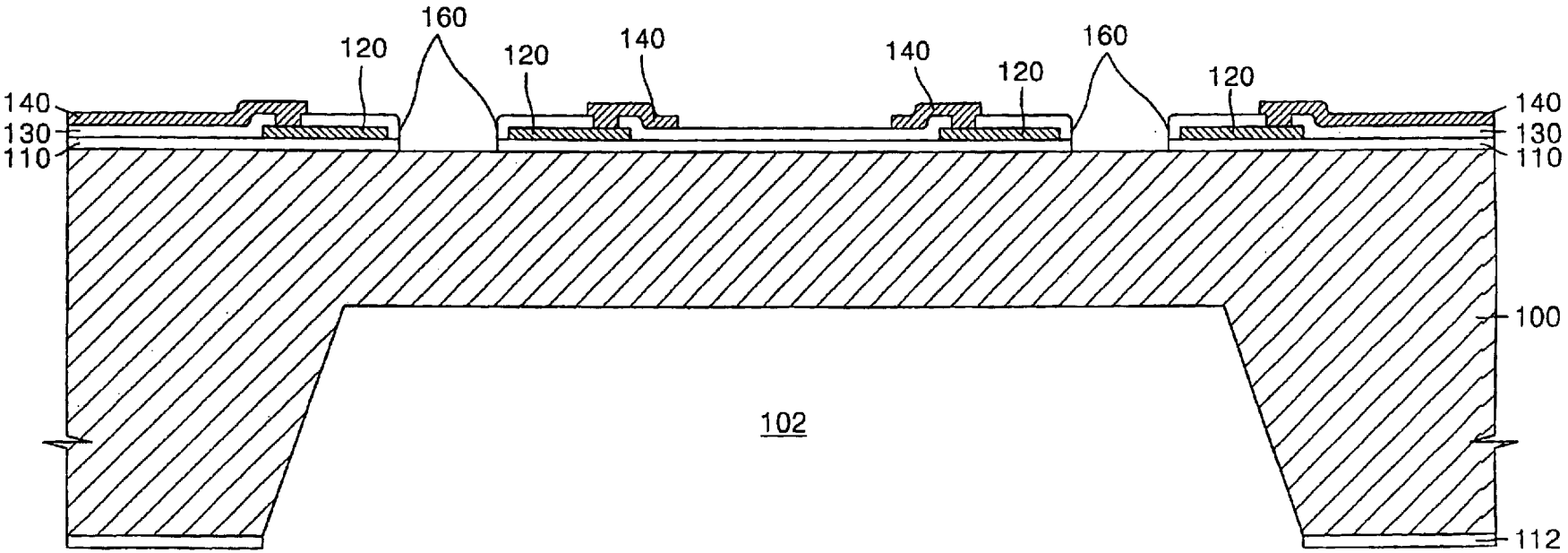

FIG. 13 illustrates a state in which the electrodes 140 and the nozzle 160 have been formed. Specifically, a portion of the silicon nitride layer 130 in which the top of the heater 120 is connected to the electrodes 140, and a portion for forming the nozzle 160 having a diameter less than an inner diameter of the annular heater 120 are etched to expose the heater 120 and the silicon oxide layer 110, respectively. Subsequently, the exposed silicon oxide layer 110 is etched to expose a portion of the substrate 100 in which the nozzle 160 is to be formed. In this case, the silicon nitride layer 130 and the silicon oxide layer 110 are etched so that the diameter of the nozzle 160 is on the order of 16–20 μm.

Next, the electrodes 140 are formed by depositing metal having good conductivity and patterning capability, such as aluminum or aluminum alloy, to a thickness of about 1 μm and patterning it. In this case, the metal layer of the electrodes 140 is simultaneously patterned so as to form wiring lines (not shown) and the bonding pad (20 of FIG. 2) in other portions of the substrate 100.

Figure 14:
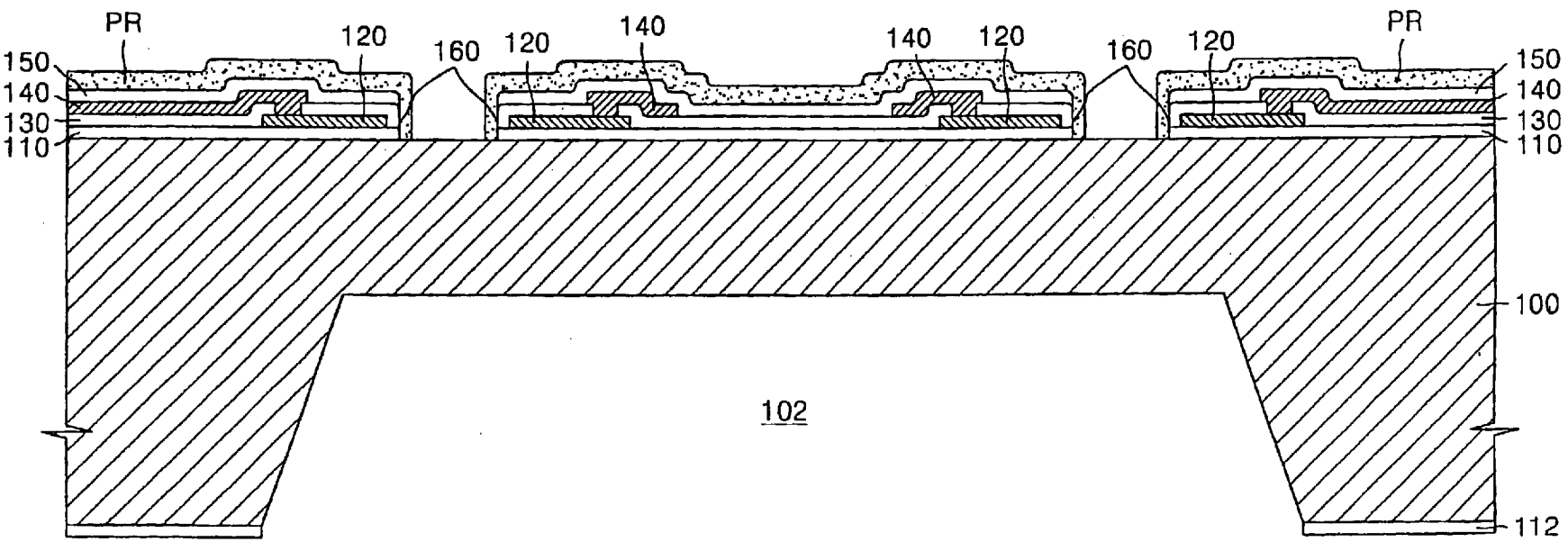

Then, as illustrated in FIG. 14, a TEOS oxide layer 150 is deposited over the substrate 100 and patterned to expose the substrate 100 on which the nozzle 160 is to be formed. The TEOS oxide layer 150 is formed by CVD, in which the TEOS oxide layer 150 may be deposited to a thickness of about 1 μm at low temperature where the electrode 140 and the bonding pad made from aluminum or aluminum alloy are not transformed, for example, at no greater than 400° C. It has been described above that the nozzle 160 is formed by patterning the silicon nitride layer 130 and the silicon oxide layer 110 before forming the TEOS oxide layer 150. Alternatively, the nozzle 160 may be formed by not patterning the silicon nitride layer 130 and the silicon oxide layer 110 until the TEOS oxide layer 150 is formed, and then sequentially etching the TEOS oxide layer 150, the silicon nitride layer 130, and the silicon oxide layer 110.

Next, the substrate 100 exposed by the nozzle 160 is etched to form the ink chamber 104 having a substantially hemispherical shape. More specifically, as illustrated in FIG. 14, photoresist is applied over the substrate 100 on which the nozzle 160 is formed, and patterned to form a photoresist pattern PR exposing the substrate 100 with a diameter less than the nozzle 160. The photoresist pattern PR is provided to finely adjust the thickness of the ink channel 106 to be later formed. That is, the diameter of the ink channel 106 is controlled by the thickness of the photoresist pattern PR remaining along sidewalls of the nozzle 160. The photoresist pattern PR does not need to be formed if the diameter of the ink channel 106 is substantially equal to that of the nozzle 160.

Figure 15:
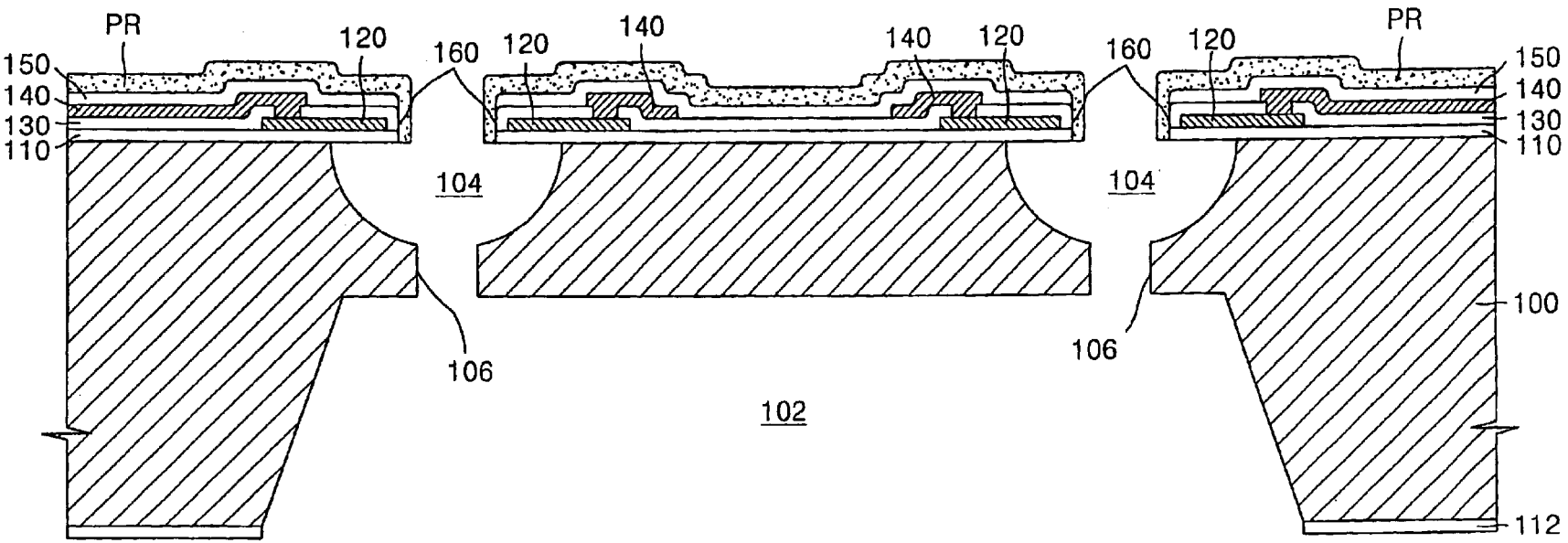

FIG. 15 illustrates a state in which the substrate 100 exposed by the nozzle 160 is etched to a predetermined depth to form the ink chamber 104 and the ink channel 106. First, the ink chamber 104 may be formed by isotropically etching the substrate 100 using the photoresist pattern PR as an etch mask. More specifically, a dry etch is performed on the substrate 100 for a predetermined period of time using $XeF_2$ as an etch gas. Then, as illustrated in FIG. 15, the substantially hemispherical ink chamber 200 is formed with depth and radius of about 20 μm.

The ink chamber 104 may be formed by anisotropically etching the substrate 100 using the photoresist pattern PR as an etch mask and then isotropically etching it. Specifically, the silicon substrate 100 may be anisotropically etched by means of inductively coupled plasma etching or reactive ion etching using the photoresist pattern PR as an etch mask to form a hole (not shown) having a predetermined depth. Then, the silicon substrate 100 is isotropically etched in the manner as described above.

Furthermore, the ink chamber 104 may be formed by changing a part of the substrate 100 in which the ink chamber 104 is to be formed into a porous silicon layer and selectively etching and removing the porous silicon layer. Specifically, a mask that exposes only a central portion of the part for forming the ink chamber 104 is formed of a silicon nitride layer on a front surface of the silicon substrate 100 on which nothing is formed (step prior to that illustrated in FIG. 11), and an electrode material such as a gold layer is formed on a rear surface of the substrate 100. The substrate 100 is subjected to anodizing in a HF solution to form a porous silicon layer substantially in a hemispherical shape, the center of which is the portion exposed by the mask. The steps 11–14 are performed on the silicon substrate 100 processed in this way and then only the porous silicon layer is selectively etched and removed to form the hemispherical ink chamber 104 as illustrated in FIG. 15. A strong alkaline solution such as potassium hydroxide (KOH) is used as an etchant for selectively etching and removing only the porous silicon layer. The anodizing process may be performed prior to the step illustrated in FIG. 11 as described above, or after the step illustrated in FIG. 13 if the nozzle 160 is used as a mask during the anodizing process.

Subsequently, the substrate 100 is anisotropically etched using the photoresist pattern PR as an etch mask to form the ink channel 106 linking the ink chamber 104 and the manifold 102 at the bottom of the ink chamber 104. The anisotropic etching may be performed by inductively coupled plasma etching or reactive ion etching as described above.

Figure 16:
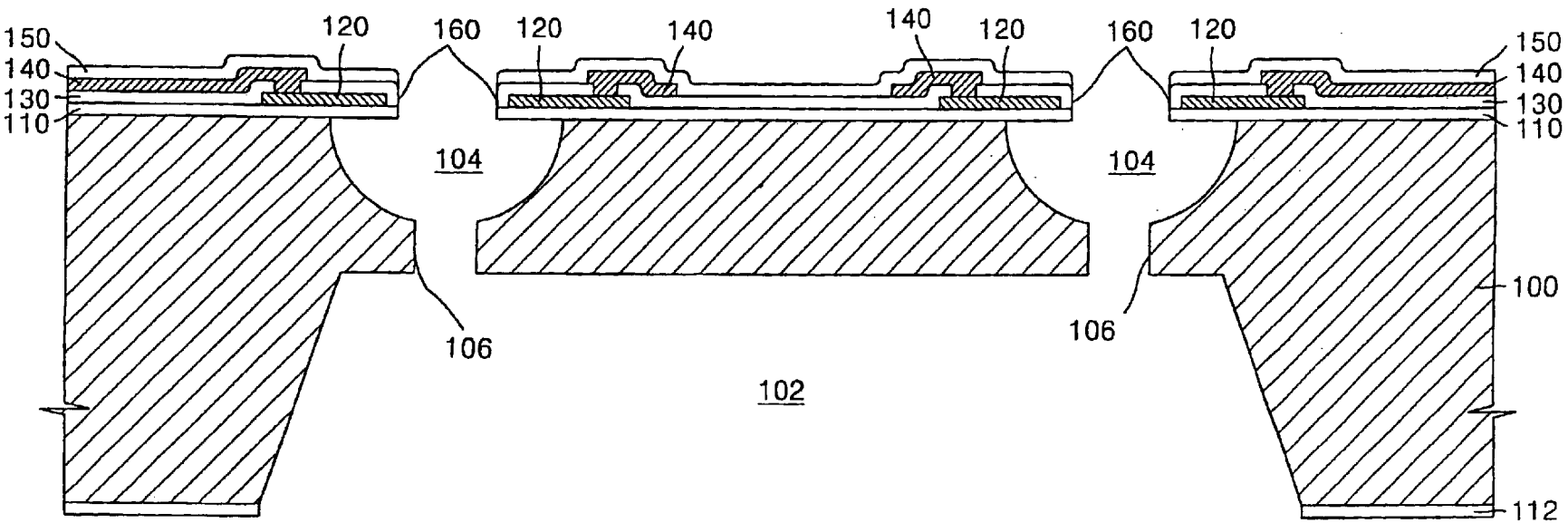

FIG. 16 illustrates a state in which the photoresist pattern PR is removed by ashing and strip in the state illustrated in FIG. 15 to complete the printhead according to this embodiment. As illustrated in FIG. 16, the photoresist pattern PR is removed to obtain the printhead having the hemispherical ink chamber 104 on a surface of the substrate 100, the manifold 102 on its bottom side, the ink channel 106 linking the ink chamber 104 and the manifold 102, and a nozzle plate on which a nozzle 160 having a diameter greater than that of the ink channel 106 is formed.

Figure 17:
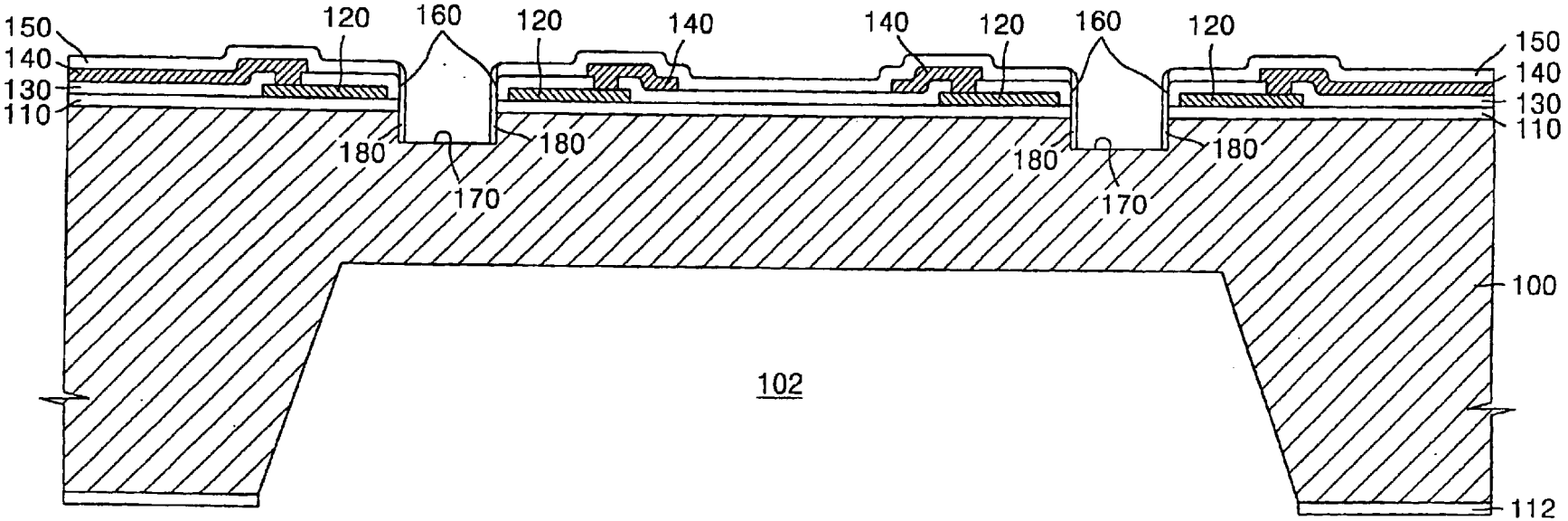
FIGS. 17 and 18 illustrate cross-sections taken along line 11—11 of FIG. 2, showing a method of a bubble-jet type ink-jet printhead according to an embodiment of the present invention having the ink ejector of FIG. 6.
Figure 18:
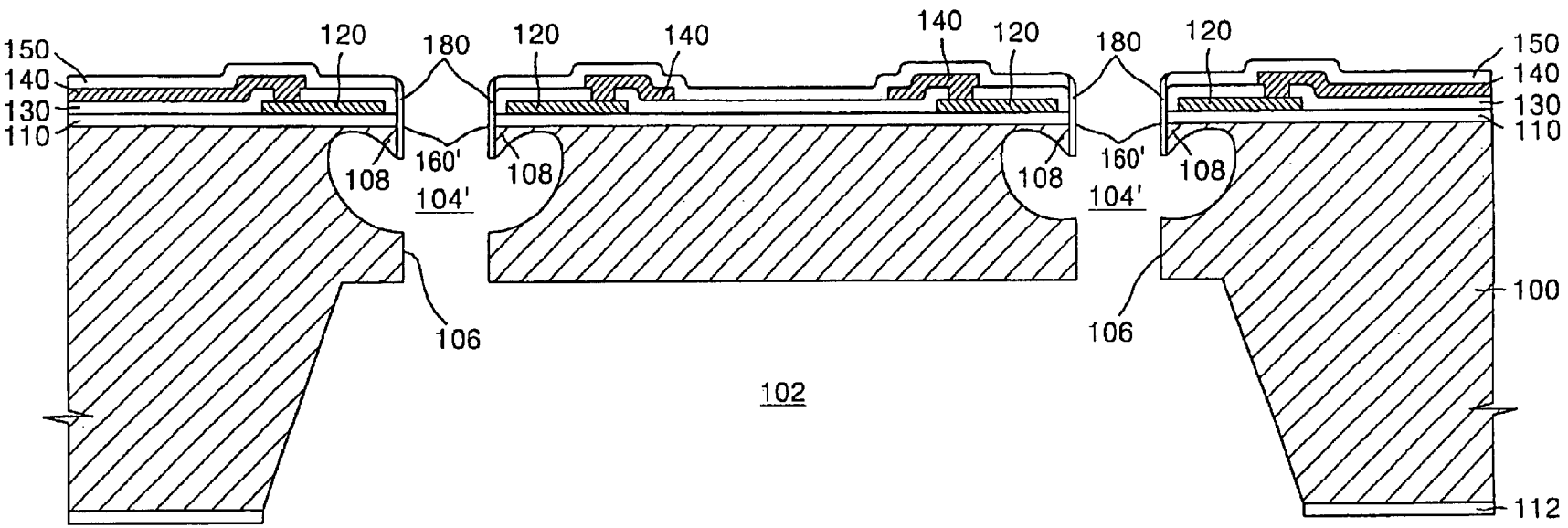

FIGS. 17 and 18 illustrate cross-sections taken along line 11—11 of FIG. 2, which illustrate a method of manufacturing a printhead having the ink ejector of FIG. 6. The manufacturing method according to this embodiment is the same as that for the printhead having the ink ejector of FIG. 4 up to the step of forming the TEOS oxide layer 150 as illustrated in FIG. 14, and it further includes the steps illustrated in FIGS. 17 and 18.

Specifically, after the TEOS oxide layer 150 has been formed as illustrated in FIG. 14, the substrate 100 is anisotropically etched to a predetermined depth using the TEOS oxide layer 150 and the silicon nitride layer 130, on which the nozzle 160 is formed, as an etch mask to form a hole 170 as illustrated in FIG. 17. Subsequently, a predetermined material layer such as a TEOS oxide layer is deposited over the substrate 100 to a thickness of about 1 $\mu$m, and then the TEOS oxide layer is anisotropically etched so that the hole 170 of the silicon substrate 100 may be exposed. As a result of anisotropic etching, a spacer 180 is formed along a sidewall of the hole 170.

If the exposed silicon substrate 100 is isotropically etched in a state illustrated in FIG. 17 in the manner described above, a printhead having the bubble guide 108 and the droplet guide 180 around the nozzle 160', both of which extend toward the ink chamber 104', is provided as illustrated in FIG. 18.

Although this invention has been described with reference to preferred embodiments thereof, it will be understood by those of ordinary skill in the art that various modifications may be made to the invention without departing from the spirit and scope thereof. For example, materials forming elements of a printhead according to this invention may not be limited to those described herein. Specifically, the substrate 100 may be formed of a material having good processibility, other than silicon, and the same is true of the heater 120, the electrode 140, a silicon oxide layer, or a nitride layer. Furthermore, the stacking and formation method for each material layer are only examples, and a variety of deposition and etching techniques may be adopted.

Also, the sequence of processes in a method of manufacturing a printhead according to this invention may be varied. For example, etching the rear surface of the substrate 100 for forming the manifold 102 may be performed before the step illustrated in FIG. 12 or after the step illustrated in FIG. 13, that is, the step of forming the nozzle 160. Furthermore, specific numeric values illustrated in each step may vary within a range in which the manufactured printhead can operate normally.

As described above, in this invention, the bubble is doughnut-shaped and the ink chamber is hemispherical, thereby preventing a back flow of ink and thus cross-talk between adjacent ink ejectors.

The shape of the ink chamber, the ink channel, and the heater in the printhead according to this invention provide a high response rate and high driving frequency. Furthermore, doughnut-shaped bubbles coalesce at the center, which prevents the formation of satellite droplets.

This invention makes it easier to control a back flow of ink and driving frequency by controlling the diameter of the ink channel. Furthermore, the ink chamber, the ink channel, and the manifold are arranged vertically to reduce the area occupied by the manifold on a plane, thereby increasing the integration density of a printhead.

This invention allows the droplets to be ejected in a direction perpendicular to the substrate by forming the bubble guide and the droplet guide on the edges of the nozzle.

Furthermore, according to a conventional printhead manufacturing method, a nozzle plate, an ink chamber, and an ink channel are manufactured separately and bonded to each other. However, a method of manufacturing a printhead according to this invention involves forming the nozzle plate and the annular heater integrally with the substrate on which the manifold, the ink chamber and the ink channel are formed, thereby simplifying the fabricating process compared with the conventional manufacturing method. Furthermore, this prevents occurrences of misalignment.

In addition, the manufacturing method according to an embodiment of the present invention is compatible with a typical manufacturing process for a semiconductor device, thereby facilitating high volume production.

What is claimed is:

1. A method of manufacturing a bubble-jet type ink-jet printhead, the method comprising the steps of:

forming a nozzle plate on a surface of a substrate;

forming a heater having an annular shape on the nozzle plate;

forming a manifold for supplying ink from the bottom side of the substrate toward the surface of the substrate;

forming an electrode electrically connected to the annular heater on the nozzle plate;

etching the nozzle plate and forming a nozzle having a diameter less than an inner diameter of the annular heater;

etching the substrate exposed by the nozzle and forming an ink chamber having a diameter greater than that of the annular heater, wherein the ink chamber has a substantially hemispherical shape, and wherein forming the ink chamber includes:

anisotropically etching the substrate exposed by the nozzle to a predetermined depth and forming a hole;

depositing predetermined material layer over the anisotropically etched substrate to a predetermined thickness;

anisotropically etching the material layer to expose the bottom of the hole while forming a spacer of the material layer along a sidewall of the hole; and isotropically etching the substrate exposed to the bottom of the hole; and forming an ink channel linking the ink chamber and the manifold at the bottom of the ink chamber.

2. The method as claimed in claim 1, after the step of forming the nozzle, further comprising the step of forming an etch mask exposing the substrate with a diameter less than that of the nozzle, wherein in the steps of forming the ink chamber and the ink channel, the substrate is etched using the etch mask in order to form the ink chamber and the ink channel; and after the step of forming the ink chamber, the etch mask is removed.

3. The method as claimed in claim 1, wherein, in the step of forming the ink chamber, the substrate exposed by the nozzle is isotropically etched to form the ink chamber.

4. The method as claimed in claim 1, wherein the step of forming the ink chamber comprises the steps of:

anodizing a portion of the substrate in which the ink chamber is to be formed and forming a porous layer substantially in a hemispherical shape; and selectively etching and removing the porous layer.

5. The method as claimed in claim 1, wherein, in the step of forming the ink channel, the substrate in which the ink chamber is formed is anisotropically etched using the nozzle plate having the nozzle as an etch mask to form the ink channel.

6. The method as claimed in claim 1, wherein the heater is formed substantially in the shape of the character "O", and the electrode is connected to each of two locations that are symmetrical to each other and located in the "O"-shaped heater.

7. The method as claimed in claim 1, wherein the heater is formed substantially in the shape of the character "C", and the electrode is connected to each end of the "C"-shaped heater.

8. The method as claimed in claim 1, wherein the heater is formed from polycrystalline silicon doped with impurities or tantalum-aluminum.

9. The method as claimed in claim 1, wherein the substrate is formed of silicon.

10. The method as claimed in claim 9, wherein, in the step of forming the nozzle plate, the nozzle plate is formed of a silicon oxide layer formed by oxidating the surface of the silicon substrate.

* * * * *